US005179829A

United States Patent [19]

Grecksch et al.

[11] Patent Number: 5,179,829

[45] Date of Patent: Jan. 19, 1993

[54] COMBINED TEXTILE YARN SPINNING AND WINDING SYSTEM HAVING SPINNING TUBE TRANSPORTING MEANS

[75] Inventors: Hans Grecksch; Frank Paetzold, both of Monchengladbach, Fed. Rep. of Germany

[73] Assignee: W. Schlafhorst AG & Co., Monchengladbach, Fed. Rep. of Germany

[21] Appl. No.: 821,854

[22] Filed: Jan. 15, 1992

Related U.S. Application Data

[63] Continuation of Ser. No. 538,249, Jun. 14, 1990, abandoned.

[30] Foreign Application Priority Data

Jun. 15, 1989 [DE] Fed. Rep. of Germany ..... 3919541
Mar. 21, 1990 [DE] Fed. Rep. of Germany ..... 4008990

[51] Int. Cl.[5] ..... D01H 9/10; D01H 9/00

[52] U.S. Cl. ..... 57/281; 57/90; 57/264; 242/35.5 A

[58] Field of Search ..... 57/90, 264, 281; 242/35.5 A

[56] References Cited

U.S. PATENT DOCUMENTS

| | | | |
|---|---|---|---|
| 3,506,209 | 10/1966 | Matsui et al. | 242/35.5 A |
| 3,538,990 | 11/1970 | Brouwer | 242/35.5 A |
| 4,571,931 | 2/1986 | Kupper | 242/35.5 A |
| 4,660.370 | 4/1987 | Matsui et al. | 57/265 X |
| 4,730,450 | 3/1989 | Tone | 57/281 |
| 4,736.581 | 4/1988 | Uchida | 57/90 X |
| 4,772,174 | 9/1988 | Küpper | 242/35.5 A |
| 4,790,131 | 12/1988 | Uchida | 57/90 X |
| 4,843,808 | 7/1989 | Rüge et al. | 57/276 X |
| 4,845,937 | 7/1989 | Kiriake et al. | 242/35.5 A X |
| 4,846,618 | 7/1989 | Matsui | 242/35.5 A X |
| 4,930,302 | 6/1990 | Yamamoto et al. | 242/35.5 A X |
| 4,964,269 | 10/1990 | Dinkelmann | 57/90 X |
| 5,056,725 | 10/1991 | Wirtz et al. | 242/35.5 R X |

FOREIGN PATENT DOCUMENTS

| | | |
|---|---|---|
| 1901638 | 9/1969 | Fed. Rep. of Germany . |
| 1760689 | 2/1972 | Fed. Rep. of Germany . |
| 2259168 | 6/1973 | Fed. Rep. of Germany . |
| 3235442 | 4/1983 | Fed. Rep. of Germany . |
| 3627586 | 3/1987 | Fed. Rep. of Germany . |
| 3628045 | 3/1987 | Fed. Rep. of Germany . |
| 3637172 | 5/1988 | Fed. Rep. of Germany . |
| 3911799 | 10/1990 | Fed. Rep. of Germany . |

OTHER PUBLICATIONS

Murata Machinery Ltd., "No. 7-II Link Coner", Cat. No. 41B282 87-10-1 (NS).

*Primary Examiner*—Daniel P. Stodola
*Assistant Examiner*—William Stryjewski
*Attorney, Agent, or Firm*—Shefte, Pinckney & Sawyer

[57] ABSTRACT

In a combined textile yarn spinning and winding system having a yarn spinning machine and a yarn winding machine, a transport system is provided for conveying spinning tubes mounted on tube support members between the spinning and winding machines. Separate respective sets of tube support members are provided in association with the spinning and winding machines and separate closed transport conveyor loops are provided in association with the machines for conveying their respective sets of tube support members. Tube transfer mechanisms are provided between the two transfer loops for transferring yarn-wound cops from tube support members in the spinning machine loop onto empty tube support members in the winding machine loop and for transferring empty spinning tubes from tube support members in the winding machine loop onto empty tube support members in the spinning machine loop. Codings are provided on the tube support members in the winding machine loop to enable each cop placed thereon to be identified according to the spinning station of the spinning machine at which it was produced.

8 Claims, 1 Drawing Sheet

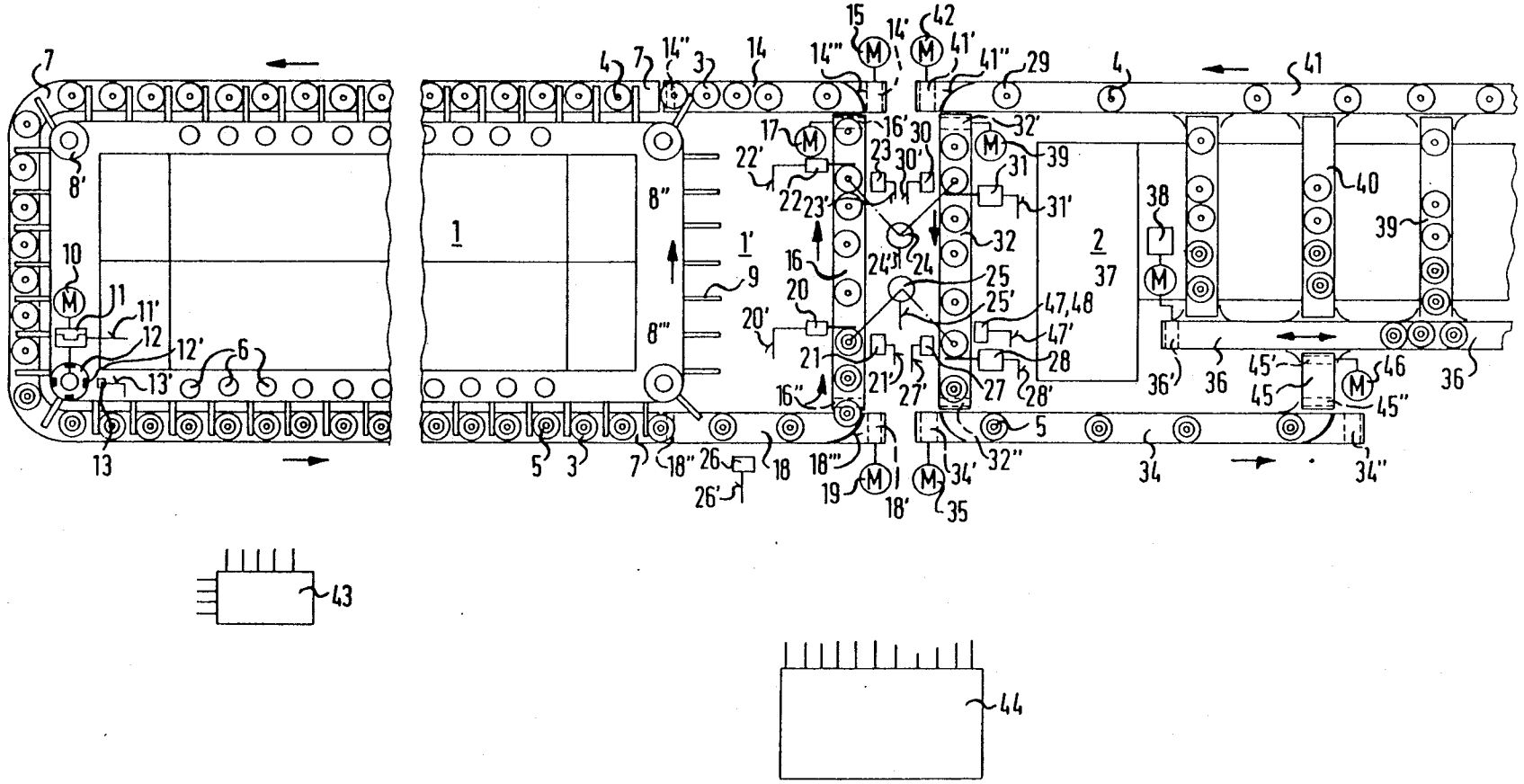

COMBINED TEXTILE YARN SPINNING AND WINDING SYSTEM HAVING SPINNING TUBE TRANSPORTING MEANS

This is a continuation of co-pending application Ser. No. 538,249, filed Jun. 14, 1990, now abandoned.

BACKGROUND OF THE INVENTION

The present invention relates to a combined textile yarn spinning and winding system having a yarn spinning machine, a yarn winding machine, and associated means for transporting spinning tubes mounted on tube support members, e.g., peg trays, between the spinning and winding machines.

It is known in the textile industry to place textile yarn spinning tubes on tube support members to avoid damage to the tubes and to yarn wound thereon during transportation from one processing location to another. One common type of tube support member is a so-called peg tray having a circular substantially flat disk-like base from which a pin extends upwardly to be received within the interior of a compatible spinning tube for mounting of the spinning tube thereon.

It is also known in the textile industry to arrange yarn spinning and winding machines in operative connection with one another. For example, West German Offenlegunsschrift DE-OS 32 35 442 discloses such a spinning and winding machine combination wherein peg tray-type tube support members are utilized to transport spinning tubes wound with yarn, sometimes referred to as cops, and empty spinning tubes along a closed circuit loop between the machines. In this system, it is therefore necessary that both the spinning and winding machines be adapted to utilize a common type and size of peg tray-type tube support member. The total number of tube support members must be selected so that both machines are continuously and sufficiently supplied with yarn-wound cops or empty tubes, as the case may be. Further, it is sometimes desirable when supplying yarn-wound cops from the spinning machine to the winding machine to identify each cop by the spinning station of the spinning machine at which the cop was produced. Accordingly, for this purpose, it is customary to provide a coded marking, preferably electronically readable, on each tube support member.

SUMMARY OF THE INVENTION

It is accordingly an object of the present invention to provide a means for transporting spinning tube support members in a combined textile yarn spinning and winding system which does not require uniformity in the type and size of tube support members utilized with the spinning and winding machines and wherein pertinent information concerning the yarn-wound cops produced by the spinning machine, e.g., the identity of the spinning station at which each cop was produced, can be supplied to the winding machine in a cost effective manner.

According to the present invention, these objectives are achieved by providing, in a combined textile yarn spinning and winding system, a means for transporting spinning tubes mounted on tube support members between the combined spinning and winding machines utilizing a first closed transport loop in association with the spinning machine for transportation of tube support members associated with the spinning machine and a second closed transport loop in association with the winding machine for transportation of tube support members associated with the winding machine.

In the preferred embodiment, the spinning machine is of the type which includes a spinning region having a plurality of spinning stations and a head region at one end of the machine positioned intermediate the spinning region and the winding machine. A portion of the first closed transport loop is formed by means arranged for movement in a continuous path about only the spinning region of the spinning machine to extend along the spinning stations thereof for positive transporting engagement with tube support members of the spinning machine, the engagement means terminating in the first loop at the head region of the spinning machine whereat the engagement means is arranged to release the tube support members onto a conveyor belt arrangement extending about the head region of the spinning machine for continued transportation of the tube support members in the first loop. The conveyor belt arrangement includes extents adapted for temporary transient storage of the tube support members of the spinning machine. In the head region of the spinning machine, a suitable arrangement is provided for transferring spinning tubes from the tube support members in the first closed transport loop to tube support members in the second closed transport loop, and vice versa.

Preferably, an arrangement is provided in the head region of the spinning machine for counting spinning tubes transported from the spinning region of the spinning machine and for associating with each tube support member in the second closed transport loop to which a spinning tube is transferred from the first loop an indicia of the spinning station of the spinning machine which produced the transferred spinning tube. For example, each tube support member in the second loop associated with the winding machine may be provided with an erasably encodable element, in which case the counting and associating means includes means for encoding each element with the indicia for each spinning tube placed on the associated tube support member. Alternatively, each tube support member in the second loop may have a respective permanent coding, in which case the counting and associating arrangement includes means for reading and storing the coding as the indicia for each spinning tube placed on the associated tube support member.

Advantageously, the formation of separate closed transport loops for the spinning machine and for the bobbin winding machine makes it possible to utilize differing types or sizes of tube support members for the two machines, which is particularly advantageous if the manufacturer of the spinning machine and the manufacturer of the associated bobbin winding machine are different from one another. Accordingly, the flexibility of the combination of spinning and winding machine systems is considerably increased.

Since it is common that the number of tube support members required for the spinning machine is a multiple of the number of spinning tube support members required for the bobbin winding machine, the present transport system provides the additional advantage of considerably reducing the expense for coding the tube support members because a coding will be necessary only for the tube support members associated with the bobbin winding machine.

It is further preferred that the arrangement for transferring spinning tubes between the first and second transport loops be adapted to grasp the tubes only at their upper tip or end, thereby above the windings of yarn on a yarn-wound cop, to prevent damage to the wound yarn.

The conveyor belt arrangement forming the portion of the first closed transport loop about the head region of the spinning machine is preferably adapted to transport the tube support members only by frictional contact. The tube support members are transported by forced positive engagement only by the engagement means in the spinning region of the spinning machine, i.e., along the spinning stations. Accordingly, it is possible to utilize the conveyor belt portion of the first loop in the head region of the spinning machine for temporary transient storage of the tube support members, which is necessary and desirable to provide flexibility to a combined spinning and winding system. The head region of the spinning machine typically comprises its end frame area, which is a necessary part of conventional spinning machines and is typically provided with central supply mechanisms. Since this portion of the spinning machine is located within the extent of the first transport loop wherein the tube support members are not transported under forced positive engagement, the storage or reserve extent of the transport loop does not require additional floor space, thereby shortening the overall length of a combined spinning and winding system by the reserve extent of the transport system which otherwise would be necessary. The reserve extent provided by the conveyor belt arrangement in the head region of the spinning machine offers the further advantage of enabling a predetermined number of tube support members to be accumulated at the tube transfer arrangement so that the tube transfer operation can be carried out in groups of tubes.

BRIEF DESCRIPTION OF THE DRAWING

The drawing schematically illustrates a textile yarn spinning machine and bobbin winding machine associated in combination with one another by a transport arrangement in accordance with the preferred embodiment of the present invention.

DESCRIPTION OF THE PREFERRED EMBODIMENT

Referring now to the accompanying drawing, a textile ring spinning machine is broadly indicated at 1 and a textile bobbin winding machine is broadly indicated at 2 arranged end-to-end in combination with one another for transferral of spinning tubes between the spinning and winding machines 1,2, utilizing a transporting arrangement according to the present invention by which the spinning tubes are conveyed while mounted on tube support members of the peg tray type.

The spinning machine 1 basically includes a spinning region comprised of a plurality of spinning stations, each having a driven spinning spindle 6, aligned with one another along each opposite lengthwise side of the machine 1 and a head region 1' at the end of the machine 1 adjacent the winding machine 2 comprised of the end frame of the machine which contains its central supply devices and mechanisms. The transport arrangement includes a horizontally-extending track 7 of a horseshoe shape extends about the spinning region of the spinning machine 1 alongside each set of spindles 6 for guided sliding movement of peg tray tube support members 3 therealong. An endless flat metal belt 8 is driven along the track 7 in a continous generally rectangular path extending about a drive roller 12 and three spaced guide rollers 8', 8'', 8'''. The metal belt is oriented with its transverse or lateral dimension extending vertically and a plurality of cam-like engagement arms 9 extend horizontally outwardly from the belt 8 at regular spacings therealong. The drive roller 12 is driven via a controllable coupling 11 by a drive motor 10, the coupling 11 being actuated via a control lead 11' by a central control unit 43 of the ring spinning machine 1. The drive roller 12 includes peripheral markings 12' which are recognizable by a pulse receiver 13 which is also connected to the spinning machine control unit 43 via a lead 13'. The spacing of the engagement arms 9 corresponds to the spacing of the spindles 6 of the spinning machine 1. In this manner, driven movement of the metal belt 8 may be accomplished in a step-wise fashion to assure that the tube support members 3 on the track 7 are always positioned precisely adjacent the spindles 6 of the spinning machine 1.

As is known, yarn spinning tubes are mounted on the spindles 6 for winding of yarn thereabout as the yarn is spun at each spinning station of the spinning machine. When the spinning tubes have been wound to their full capacity with yarn (commonly referred to as cops), the cops are removed from the spindles and replaced by empty tubes. According to the basic concept of operation of a combined textile yarn spinning and winding system, the yarn-wound cops are transported to the winding machine for unwinding of the yarn onto larger yarn packages, thereby producing empty tubes which are returned to the spinning machine 1. In the drawing, fully-wound cops are representatively indicated at 5, while empty spinning tubes are representatively indicated at 4.

The exchange of empty tubes 4 from the bobbin winding machine 2 for cops 5 produced on the spinning spindles 6 of the spinning machine 1 is accomplished automatically utilizing a doffer mechanism (not shown). Such doffers are known in the textile arts, representative doffers being disclosed in West German Offenlegunsschrift DE-OS 19 10 638 and West German Offenlegunsschrift DE OS 22 59 168. Such doffers may be equipped with a control connection to the central control unit 43 of the spinning machine 1. Accordingly, through the control unit 43, the motion of the metal belt 8 may be coordinated via the coupling 11 with the operation of the doffer.

As illustrated in the drawing, the guide rollers 8'', 8''' for the metal belt 8 are located at the end of the spinning region of the spinning machine 1 adjacent the head region 1', whereby the belt 8 does not travel about the head region 1' but instead travels transversely from the guide roller 8''' to the guide roller 8'' adjacent the head region 1'. The tube support members 3 of the spinning machine 1 do not travel transversely with the metal belt 8 and its arms 9 but instead are released from the arms 9 and transferred onto a flat delivery conveyor belt 18 arranged horizontally in alignment with the guide track 7 about a drive roller 18' which drives the belt 18 via a drive motor 19 and a guide roller 18''. As will be understood, the conveyor 8 through engagement of its arms 9 with the tube support members 3 effects a forced positive transportation of the tube support members 3 along the guide track 7. However, in contrast, the tube support members 3 merely rest on the top run of the delivery belt 18 for conveyance solely by frictional contact therewith rather than forced positive engagement.

The delivery belt 18 forms a reserve stretch for temporary transient reserve storage of the cops 5 supported on the tube support members 3 alongside the head region 1' of the spinning machine, whereby the reserve extent, which as aforementioned, is necessary for maintaining flexibility of the combined spinning and winding system, does not require additional floor space. As will also be understood, the provision of the delivery belt 18 alongside the head region 1' of the spinning machine 1 can also serve such reserve function within the scope of the present invention in embodiments wherein a single transport loop extends about both the spinning and winding machines 1, 2.

As the tube support members 3 are transported by the delivery belt 18, the tube support members 3 are brought into engagement with an arcuate guide member 18''' which deflects the tube support members 3 onto another conveyor belt 16 which travels transversely of the spinning machine 1 at the end of its head region 1' about a drive roller 16' driven continuously by a drive motor 17 and a guide roller 16''. As with the delivery belt 18, the tube support members 3 rest on the upper run of the transverse belt 16 for conveyance solely by frictional contact therewith.

As the tube support members 3 are transported along the transverse belt 16, the tube support members 3 are brought into engagement with another arcuate guide member 14''' at the end of the conveyor belt 16, which guide member 14''' deflects the tube support members 3 onto a take-away conveyor belt 14. The take-away belt 14 is horizontally oriented in alignment with the guide track 7 at the opposite side of the spinning machine 1 about a drive roller 14' driven by a drive motor 15 and a guide roller 14''. The upper run of the take-away belt 14 is thereby driven toward the guide track 7 for transporting the tube support members 3 by frictional contact to the adjacent end of the track 7 whereat the arms 9 of the conveyor 8 engage the support members 3 at the completion of the transverse extent of travel of the conveyor 8 at the guide roller 8'' for positive engagement and transportation of the tube support members 3 alongside the spinning stations at the opposite side of the spinning machine 1.

After the tube support members 3 of the spinning machine have been deflected by the arcuate guide member 18''' onto the transverse conveyor belt 16, the tube support members 3 engage a stop mechanism 23, which prevents further movement of the tube support members 3 with the transverse belt 16. At this point, each of the stopped tube support members 3 carry a fully wound cop 5 produced by the ring spinning machine 1, the stop mechanism 20 being adapted to position the leading tube support member 3 for grasping and transfer of its supported cop 5 to the winding machine 2 by a transfer mechanism 25, representatively indicated at 25, disposed between the adjacent ends of the spinning and winding machines 1, 2.

In order to initiate the cop transferral process, it is necessary that an empty tube support member 29 associated with the bobbin winding machine 2 be positioned directly opposite the leading tube support member 3 held by the stop mechanism 20. For this purpose, the transport arrangement of the present invention includes a conveyor belt arrangement defining a closed transportation loop about the winding machine 2 similarly to the closed transportation loop about the spinning machine 1 defined by the guide track 7, the conveyor 8, and the delivery, transverse and take-away belts 18, 16, 14. The transportation loop of the winding machine 2 includes a conveyor belt 32 extending transversely with respect to the end of the winding machine 2 adjacent the spinning machine 1 about a drive roller 32' driven by a drive motor 33 and a guide roller 32''. As indicated by the directional arrows, the direction of travel of tube support members 29 along the transportation loop of the winding machine 2 is opposite that of the transportation loop of the spinning machine 1, whereby the end belt 32 travels oppositely of the transverse belt 16. A stop mechanism 28 is associated with the end belt 32 to position a tube support member 29 associated with the winding machine 2 directly opposite the leading tube support member 3 at the stop mechanism 20.

The positioning of tube support members 3 and 29 by the stop mechanisms 20 and 28 is monitored by sensors 21 and 27 which are connected via respective leads 21', 27' to a central control unit 44 for the combined spinning and winding system. Similarly, the central control unit 44 is operatively connected to the stop mechanisms 20 and 28 via control leads 20', 28', respectively, and the central control unit 44 is operatively connected with the transfer mechanism 25 via a control line 25'.

Another transfer mechanism 24 is disposed between the adjacent ends of the spinning and winding machines 1, 2, adjacent to the transfer mechanism 25. While as aforementioned the transfer mechanism 25 is operative to transfer fully-wound cops 5 from the tube support members 3 of the spinning machine 1 onto empty tube support members 29 associated with the bobbin winding machine 2, the transfer mechanism 24 operates in reverse to transfer empty yarn spinning tubes 4 from tube support members 29 of the bobbin winding machine 2 onto tube support members 3 of the spinning machine 1 from which cops 5 were previously removed by the transfer mechanism 25. In association with the transfer mechanism 24, a stop mechanism 22 is arranged adjacent the transfer belt 16 downstream from the stop mechanism 20 to stop and position empty tube support members 3 released by the stop mechanism 20 following a transfer operation of the transfer mechanism 25 and, similarly, a stop mechanism 31 is arranged adjacent the end belt 32 upstream of the stop mechanism 28 to stop and position tube support members 29 carrying empty spinning tubes in advance of delivery of the tube support members 29 to the stop mechanism 25. The presence of tube support members 3, 29 at the stop mechanism 22, 31 is monitored by respective sensors 23, 30 which are operatively connected via leads 23', 30' to the central control unit 44. The central control unit 44 operatively controls the stop mechanisms 22, 31 via control leads 22', 31', respectively, and controls the transfer mechanism 24 via a control lead 24'.

Upon actuation of the transfer mechanism 25, a fully wound cop 5 from a tube support member 3 at the stop mechanism 20 is transferred onto an empty tube support member 29 at the stop mechanism 28. Thereupon, the respective tube support members 3, 29 are released by the stop mechanisms 20, 28 to continue travel along the respective conveyor belts 16, 32. The tube support member 29 now supporting a fully wound cop 5 is transported by the conveyor belt 32 into contact with an arcuate guide member 32''' at the end of the conveyor belt 32, by which the tube support member 29 is deflected onto a main supply conveyor belt 34 extending about a drive roller 34' driven by a drive motor 35 and a guide roller 34''. At the end of the main supply belt 34, the tube support member 29 engages an arcuate guide member 34''' which directs the tube support member 29 onto a transfer conveyor belt 45 extending about a drive roller 45" driven by a drive motor 46 and a guide roller 45". The transfer belt 45 transports the tube support member 29 onto a final supply belt 36 which is driven in a cyclically reversing fashion by a drive motor 37 via a drive roller 36'. The cyclical reversals of the drive motor 37 are regulated by a control unit 38 equipped with an inverted converter or inverted rectifier. In this manner, the final supply belt 36 is driven in each opposite direction for a predetermined period of time, whereby the tube support members 29 on the belt 36 are transported past a series of winding station belts 39 which extend through the winding stations 40 of the winding machine 2. The winding station belts 39 are preferably driven via cone-pulley drives by a discharge belt 41 which extends transversely with respect to the terminal ends of each winding station belt 40.

At each winding station 40, the yarn wound on the cops 5 supported on the tube support members 29 on the associated winding station belt 39 is unwound and rewound onto a larger yarn package, each winding station taking the cops 5 of the tube support members on its winding station belt in sequence. When a winding station 40 has completed the unwinding of yarn from a cop 5, the winding station releases the tube support member 29 to allow the associated winding station belt 39 to transport the tube support member 29 and its empty supported yarn spinning tube to the discharge belt 41. The winding station 40 then proceeds with unwinding of yarn from the cop 5 on the next succeeding tube support member 29 on the associated winding station belt 39. This operation creates a vacancy on the associated winding station belt 39 for another tube support member 29 on the final supply belt 36. To automatically maintain a full supply of tube support members 29 on each winding station belt 39, the final supply belt 36 may be constructed of a lesser lateral extent than the diametric dimension of the tube support members 29 and the final supply belt 36 is arranged to overlap the entrance end of each winding station belt 39, whereby the upper run of a winding station belt 39 having a vacancy will automatically frictionally contact the underside of the first approaching tube support member 29 on the final supply belt 36 to draw the tube support member 29 onto the winding station belt 39 to occupy the vacancy.

As aforementioned, tube support members 29 released from the spinning stations 40 are transported onto the discharge belt 41, which is driven by a drive motor 42 via a drive roller 41' toward the end belt 32 as indicated by the directional arrow. At the end of the discharge belt 41, an arcuate guide member 41" deflects each tube support member 29 onto the end conveyor belt 32. As mentioned, each such tube support member 29 carries an empty yarn spinning tube 4. The end belt 32 transports the tube support members 29 in succession to the stop mechanism 31 whereat the transfer mechanism 24 transfers the empty spinning tube 4 onto an empty tube support member 3 of the spinning machine 1 at the stop mechanism 22.

As aforementioned, it is often desirable for operation of the winding machine 2 to be able to identify each cop 5 delivered to the winding stations 40 according to the particular spinning station of the spinning machine 1 at which the cop 5 was produced. For this purpose, the sensor 21 generates an impulse upon the arrival of each succeeding tube support member 3 at the stop mechanism 20 and transmits the impulse via the lead 21' to the central control unit 44 which counts the impulses. Each of the tube support members 29 associated with the winding machine 2 may carry a permanent respective electronically readable coding, e.g., a bar code or otherwise. A reading device 47 is disposed adjacent the end belt 32 immediately in advance of the stop mechanism 28 for reading the coding on each tube support member 29 arriving at the stop mechanism 28. The reading device 47 transmits the coding to the central control unit 44 via a lead 47'. Within the central control unit 44, the counted impulses received from the sensor 21 are compared with the codes of the tube support members 29 read by the reading device 47 and the control unit 44, in turn, associates and stores for each tube support member 29 the data received from the sensor 21 and the reading device 47 until each tube support member 29 is subsequently transported again to the reading device 47.

Alternatively, each tube support member 29 of the winding machine 2 may be equipped with an erasably encodable element, e.g., a microchip or the like, and, in such case, a suitable device 48 is provided instead of the reading device 47 immediately in advance of the stop mechanism 28 for erasing and encoding each tube support member 29 arriving at the stop mechanism 28 with a coding identifying the spinning station of the spinning machine 1 at which the cop transferred to the tube support member 29 was produced, as determined by the impulses transmitted by the sensor 21 to the central control unit 44. In this manner, the respective coding assigned to each tube support member 29 may be read again at the winding station 40 or on the discharge belt 41.

In either case, the coding on each tube support member 29 serves to identify the spinning station of the spinning machine 1 at which the cop supported on the tube support member 29 was produced, which enables the central control unit 44 to monitor various aspects of the spinning and winding operation. For example, if the winding machine 2 experiences a number of yarn breakages for any given cop 5 exceeding a predetermined maximum number of acceptable breakages, then the coding of the tube support member 29 may be read at the winding station and transmitted to the central control unit 44 or, alternatively, an identification marking or the like may be placed on the tube support member 29 or the tube 4 to activate reading of the coding on the tube support member 29 by a reading device (not shown) located alongside the discharge belt 41. In this manner, a particular spinning station of the spinning machine which is operating defectively may be readily identified. Other variations for identifying particular tube support members and/or the tubes thereon may be utilized. See, for example, West German Offenlegunsschrift DE-OS 39 11 799.

Advantageously, by utilizing separate sets of tube support members 3,29 in association respectively with the spinning machine 1 and the winding machine 2 and by separately transporting each set of tube support members 3,29 along independent closed transport loops, only the tube support members 29 associated with the bobbin winding machine 2 need carry any coding. As will be understood, the number of tube support members 29 necessary for the operation of the bobbin winding machine 2 will be only a fraction of the number of tube support members 3 necessary for operation of the spinning machine 1, whereby a substantial cost savings may be realized in comparison to a transport system wherein the same tube support members 3 are utilized for the spinning and winding machines 1,2.

Another sensor 26 may be located alongside the delivery belt 18 and operatively connected via a lead 26' to the central control unit 43 of the spinning machine 1 for purposes of recognizing a backup of tube support members 3 along the conveyor belts 16,18 from the stop mechanism 20. In such instance, the control unit 43 operates the coupling 11 to decouple the drive motor 10 from the drive roller 12 to stop further delivery of tube support members 3 onto the belt 18 until the backup of tube support members is relieved.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A combined textile yarn spinning and winding system comprising a yarn spinning machine, a yarn winding machine having a plurality of winding stations, and means for transporting spinning tubes between said spinning and winding machines by means of independent tube support members removably supported on said transporting means, said transporting means including:

(a) a first set of said independent tube support members specifically associated only with said spinning machine, (b) a second set of said independent tube support members specifically associated only with said winding machine, (c) means defining a first closed transport loop extending in a continuous path encircling said spinning machine for transportation of said first set of tube support members associated with said spinning machine in said continuous path, (d) a second closed transport loop extending in a continuous path encircling said winding stations of said winding machine for transportation of said second set of tube support members associated with said winding machine in said continuous path, and (e) means for removing spinning tubes from said first set of tube support members in said first closed transport loop and transferring said spinning tubes to said second set of tube support members in said second closed transport loop.

2. A combined textile yarn spinning and winding system according to claim 1 and characterized further in that said spinning machine includes a spinning region having a plurality of spinning stations and a head region located between said spinning region and said winding machine, said first closed transport loop comprising means movable along the spinning stations of said spinning machine for positively engaging and transporting said first set of tube support members associated with said spinning machine, said engagement means terminating in the first closed transport loop at the head region of the spinning machine whereat said engagement means is arranged to release the first set of tube support members for continued transportation in said first closed loop.

3. A combined textile yarn spinning and winding system according to claim 2 and characterized further in that said first closed transport loop comprises conveyor belt means for transporting said first set of tube support members in the head region of said spinning machine.

4. A combined textile yarn spinning and winding system according to claim 2 and characterized further in that said engagement means extends in a continuous path about only said spinning region including a portion of first closed transport loop along said spinning stations, and the remaining portion of said first closed transport loop extends about said head region of said spinning machine and includes an extent for storage of said first set of tube support members associated with said spinning machine temporarily while awaiting transfer of the spinning tubes supported thereon to the winding machine.

5. A combined textile yarn spinning and winding system according to claim 2 and characterized further in that said transferring means is located at said head region of said spinning machine, and characterized further by means at said head region of said spinning machine for counting spinning tubes transported from said spinning region and for associating with each tube support member in said second closed transport loop to which a spinning tube is transferred from said first closed transport loop an indicia of the spinning station of the spinning machine which produced the spinning tube.

6. A combined textile yarn spinning and winding system according to claim 5 and characterized further in that each tube support member of said second set in said second closed transport loop comprises an erasably encodable element, and said counting and associating means comprises means for encoding each said element with said indicia for each spinning tube placed on the associated tube support member.

7. A combined textile yarn spinning and winding system according to claim 5 and characterized further in that each said tube support member of said second set in said second closed transport loop comprises a permanent coding, and said counting and associating means comprises means for reading and storing said coding as said indicia for each spinning tube placed on the associated tube support member.

8. A combined textile yarn spinning and winding system comprising a yarn winding machine having a plurality of winding stations, a yarn spinning machine including a spinning region having a plurality of spinning stations and a head region located between said spinning region and said winding machine, and means for transporting spinning tubes between said spinning and winding machines by means of independent tube support members removably supported on said transporting means, said transporting means including:

(a) a first set of said independent tube support members specifically associated only with said spinning machine, (b) a second set of said independent tube support members specifically associated only with said winding machine, (c) a first closed transport loop extending in a continuous path encircling said spinning machine for transporting said first set of tube support members associated with said spinning machine in said continuous path, said first closed transport loop comprising means movable in a continuous path about only said spinning region for positively engaging and transporting said first set of tube support members and conveyor belt means for transporting said first set of tube support members to and from said engaging means, said conveyor belt means including extents for storage of said first set of tube support members at said head region of said spinning machine temporarily while awaiting transfer of the spinning tubes supported thereon to said winding machine, (d) a second closed transport loop extending in a continuous path encircling said winding stations of said winding machine for transportation of said second set of tube support members associated with said winding machine in said continuous path, and (e) means for removing spinning tubes from said first set of tube support members in said first closed transport loop and transferring said spinning tubes to said second set of tube support members in said second closed transport loop.

* * * * *